US009475625B2

(12) United States Patent
Di Molfetta

(10) Patent No.: US 9,475,625 B2
(45) Date of Patent: Oct. 25, 2016

(54) CLOSURE SYSTEM AND METHOD FOR RESEALING A CAULKING TUBE NOZZLE

(76) Inventor: Giulio Di Molfetta, St. Leonard (CA)

( * ) Notice: Subject to any disclaimer, the term of this patent is extended or adjusted under 35 U.S.C. 154(b) by 298 days.

(21) Appl. No.: 14/234,462

(22) PCT Filed: Jul. 19, 2012

(86) PCT No.: PCT/CA2012/000695
§ 371 (c)(1),
(2), (4) Date: May 2, 2014

(87) PCT Pub. No.: WO2013/013301
PCT Pub. Date: Jan. 31, 2013

(65) Prior Publication Data

US 2014/0231444 A1 Aug. 21, 2014

Related U.S. Application Data

(60) Provisional application No. 61/534,208, filed on Sep. 13, 2011.

(30) Foreign Application Priority Data

Jul. 23, 2011 (GB) ..... 1112783.4

(51) Int. Cl.
*B65D 47/00* (2006.01)
*B67D 3/00* (2006.01)
*B65D 51/00* (2006.01)
*B05C 17/005* (2006.01)

(52) U.S. Cl.
CPC ..... *B65D 51/00* (2013.01); *B05C 17/0052* (2013.01)

(58) Field of Classification Search
CPC .. B65D 51/00; B65D 51/16; B65D 51/1672; B65D 51/1683; B65D 39/08; B65D 41/023; B65D 41/04; B65D 41/0414; B65D 41/0435; B65D 47/122; B05C 17/0052
USPC ..... 222/563, 544, 545, 546, 552, 554; 215/316, 329; 220/288, 287
See application file for complete search history.

(56) References Cited

U.S. PATENT DOCUMENTS 3,282,478 A * 11/1966 Russell ..... B65D 47/148 222/542
4,146,152 A * 3/1979 Ogawa ..... B67B 7/24 222/151
4,213,546 A 7/1980 Massey
4,258,884 A * 3/1981 Rogers ..... B05C 17/00516 222/570

(Continued)

OTHER PUBLICATIONS

International Search Report for International PCT Application No. PCT/CA2012/000695, mailed Sep. 17, 2012.

*Primary Examiner* — J. Casimer Jacyna
*Assistant Examiner* — Benjamin R Shaw
(74) *Attorney, Agent, or Firm* — Pearl Cohen Zedek Latzer Baratz LLP

(57) ABSTRACT

There is provided a closure system for resealing a caulking tube nozzle of a caulking tube, the caulking tube nozzle having a straight cylindrical portion located near the caulking tube and a frusto-conical end portion located away from the caulking tube, the closure system comprising a hollow adaptor adapted to be removably secured to the caulking tube nozzle, the hollow adaptor comprising a first open end for sealingly receiving the caulking tube nozzle, a second open end and a passageway extending therebetween; and a plug for sealingly engaging the second open end to prevent caulking from exiting the passageway through the second open end. There is also provided a method for resealing a caulking tube nozzle.

10 Claims, 7 Drawing Sheets

(56) References Cited

U.S. PATENT DOCUMENTS 4,284,213 A * 8/1981 Lee ..... B65D 47/10 220/266
4,461,454 A 7/1984 Vadnais
5,104,013 A 4/1992 Hawley
5,154,327 A * 10/1992 Long ..... B05C 17/00516 220/375
5,295,601 A * 3/1994 Bostelman ..... B65D 35/44 215/306
5,316,054 A * 5/1994 Hall ..... B65D 41/26 141/22
6,223,957 B1 5/2001 Hoppe
6,375,051 B1 * 4/2002 Iverson ..... B05C 17/00516 222/327
6,398,085 B2 6/2002 Foster
6,481,597 B1 * 11/2002 Cermak, III ..... B05C 17/00503 215/355
6,824,026 B1 * 11/2004 Boutwell ..... B65D 41/22 222/326
2005/0230439 A1 * 10/2005 McKee ..... B65D 41/0442 222/568
2007/0215641 A1 * 9/2007 Fishman ..... B65D 35/44 222/151
2009/0032536 A1 * 2/2009 Hobbs, Sr. ..... B65D 41/023 220/287

* cited by examiner

CLOSURE SYSTEM AND METHOD FOR RESEALING A CAULKING TUBE NOZZLE

CROSS-REFERENCE TO RELATED APPLICATIONS

This application is a National Phase Application of PCT International Application No. PCT/CA2012/000695, International Filing Date Jul. 19, 2012, claiming priority of U.S. Patent Application No. 61/534,208, filed Sep. 13, 2011, and GB Patent Application No. 1112783.4, filed Jul. 23, 2011, which are hereby incorporated by reference.

TECHNICAL FIELD

The present invention relates generally to plug and closure systems used for resealing a caulking tube nozzle and, more particularly, to an improved closure system and associated method for resealing a caulking tube nozzle.

BACKGROUND

Plugs and closure systems generally used for resealing a caulking tube nozzle are known in the art and are useful for manually resealing a caulking tube cartridge after the tip of its plastic nozzle has been cut off and caulking material has been poured out therefrom.

In some instances, plugs and closure systems of the prior art are generally represented by a substantially pointed member provided with a handle-like portion, or a substantially conically shaped cap member, or equivalent, that are inserted in, slipped on, or otherwise attached to the distal end of an open nozzle.

Typical examples of plugs and closure systems of the prior art are U.S. Pat. Nos. US20050230439A1 to McKee (2005), U.S. Pat. No. 4,824,026, to Boutwell (2004), U.S. Pat. No. 6,481,597, to Cermak (2002), U.S. Pat. No. 6,398,085, to Foster (2002), U.S. Pat. No. 4,284,213, to Lee (1981), U.S. Pat. No. 4,213,546, to Massey (1980), and U.S. Pat. No. 4,146,152, to Foster (1979).

Some of these plugs and systems are designed to only engage the tip of the caulking tube nozzle. Unfortunately, they cannot be used when a relatively large portion of the tip has been cut off by the user in order to obtain a wide aperture for applying a wide strip of caulking material.

Furthermore, the tapered configuration of the inner cavity of these caps generally allows the caulking material to harden, at least partially, when the caulking tube is stored over long periods of time in a space where there are at least slight temperature variations. This is generally caused by the alternating expansions and contractions of the plastic materials of different density from which are manufactured the cap and the nozzle, combined with the tapered configuration of the latters. The result is a cap that lets air get progressively in contact with the caulking material within the tube, or even a cap that becomes loose over time.

Furthermore, the tapered cavity of prior art caps is generally configured to conform to the outer surface of a nozzle having a specific tapering angle and general surface configuration. This limitation leaves little or no margin for adequately resealing the nozzle of caulking tubes made from different manufacturers.

Another common problem with caps of the prior art is that, once the cap is secured to, and seal the open tip of a nozzle, it is relatively hard to clean properly the exceeding caulking material near and around the annular joint between the cap and the nozzle. This exceeding caulking material generally hardens and accumulates thereabout after just one or two resealing of the tube, which may impair the sealing qualities of the cap, additionally to the fact that the accumulation gets easily cumbersome and annoying when manipulating the cap.

There also exist closures of the plug type, such as U.S. Pat. No. 6,481,597, which are partially inserted into the end of the nozzle. Plugs may come off relatively easily from the nozzle if the caulking tube is accidentally dropped or mishandled, or if there's still expansion of the caulking material within the tube. The use of such plugs of the prior art also often results in the accumulation of exceeding material that is relatively hard to clean properly near and around the annular joint between the plug and the nozzle.

In some instance, plugs and closure systems of the prior art may be represented by an assembly comprising multiple custom components that require multiple-step processes to manufacture and assemble and, thus, are relatively more complex and expensive to manufacture.

Against this background, there exists a need for an improved closure system and associated method for resealing a caulking tube nozzle that overcomes at least one of the aforementioned drawbacks.

BRIEF SUMMARY

According to one aspect, there is provided a closure system for resealing a caulking tube nozzle of a caulking tube, the caulking tube nozzle having a straight cylindrical portion located near the caulking tube and a frusto-conical end portion located away from the caulking tube, the closure system comprising a hollow adaptor adapted to be removably secured to the caulking tube nozzle, the hollow adaptor comprising a first open end for sealingly receiving the caulking tube nozzle, a second open end and a passageway extending therebetween; and a plug for sealingly engaging the second open end to prevent caulking from exiting the passageway through the second open end.

In one embodiment, the passageway is adapted to receive at least part of the straight cylindrical portion of the caulking tube nozzle.

In one embodiment, the passageway comprises first and second end portions and an intermediate portion extending therebetween.

In one embodiment, the first end portion is cylindrical and has a diameter similar to the diameter of the straight cylindrical portion of the caulking tube nozzle to sealingly engage the straight cylindrical portion of the caulking tube nozzle.

In one embodiment, the intermediate portion is tapered to receive the frusto-conical end portion of the caulking tube nozzle.

In one embodiment, the first end portion comprises a helical ridge for securing the hollow adaptor to the straight cylindrical portion of the caulking tube nozzle.

In one embodiment, the intermediate portion of the longitudinal passageway comprises a plurality of spaced-apart annular protrusions, each annular protrusion defining a central opening having a certain diameter, the diameters of all of the central openings being selected such that the annular protrusions define a central conical space having a taper angle which is sharper than the taper angle of the intermediate portion of the elongated hollow member.

In one embodiment, the plug comprises pressure modifying means for modifying pressure inside the passageway.

In one embodiment, the plug comprises an elongated body extending into the passageway when the plug engages the second open end, thereby increasing pressure in the passageway in order to prevent caulking from being further dispensed from the caulking tube nozzle.

In one embodiment, the second end portion of the passageway is internally threaded and the elongated body of the plug is externally threaded to sealingly engage the second end portion.

In one embodiment, the plug comprises a conduit extending longitudinally therethrough and a valve mounted in the conduit, the valve being selectively closeable for preventing air from entering the passageway, the valve being couplable to pumping means for selectively removing air from the passageway to thereby prevent air from contacting caulking.

In one embodiment, the hollow adaptor comprises a first adaptor member having a first end portion removably securable to the caulking tube nozzle and a second end portion; and a second adaptor member having a first end portion sealingly engageable with the second end portion of the first adaptor member and a second end portion adapted for sealingly receiving the plug.

In one embodiment, the hollow adaptor and the plug are manufactured using a rigid material selected from the group consisting of hard nylon, hard polymer, rust-resistant steel, aluminum, and light metal alloy.

According to another aspect, there is also provided a method for resealing a caulking tube nozzle, the method comprising providing a hollow adaptor having a first open end, a second open end and a passageway extending therebetween; sealingly engaging the hollow adaptor on the caulking tube nozzle through the first open end; sealingly engaging a plug in the hollow adaptor through the second open end to thereby seal the passageway.

In one embodiment, sealingly engaging the hollow adaptor on the caulking tube nozzle comprises sealingly engaging the hollow adaptor on the caulking tube nozzle over at least part of a straight cylindrical portion of the caulking tube nozzle.

In one embodiment, sealingly engaging the hollow adaptor on the caulking tube nozzle comprises screwing the hollow adaptor on the caulking tube nozzle.

In one embodiment, the method further comprises modifying pressure inside the passageway.

In one embodiment, modifying pressure inside the passageway comprises moving an elongated body of the plug into the passageway towards the caulking tube nozzle to thereby increase pressure in the passageway.

This increases the pressure in the passageway and thereby advantageously prevents caulking protruding from being further dispensed from the caulking tube nozzle. This also advantageously substantially seals any potentially leaking interstitial spaces between the contacting portions of the hollow adaptor, the plug and/or the caulking tube nozzle.

In one embodiment, modifying pressure inside the passageway comprises coupling a pump to a conduit extending longitudinally through the plug; and activating the pump to remove air from the passageway to thereby prevent air from contacting caulking.

This is particularly useful for resealing the caulking tube nozzle of a caulking tube that contains highly curable material in the presence of air, such as caulking tubes typically used in the aerospace industry, and the like. Since this highly curable material is typically highly expensive, this configuration may reduce costs associated with wasted caulking by contributing to preserve this highly curable material, which is of great advantage.

It will be appreciated that the closure system and the method for resealing a caulking tube nozzle described herein may be used to reseal a caulking tube, even after a relatively large portion or most of the tapered tip portion of the nozzle has been cut off.

It will be also appreciated that the present closure system may be firmly secured to the nozzle of a caulking tube, with substantially minimized risks that the closure system becomes loose or separated from the nozzle when the resealed caulking tube is stored in tempered space over long periods of time, or when the caulking tube is accidentally dropped on the floor.

Furthermore, the closure system and the method for resealing a caulking tube nozzle described herein may be used to effectively reseal the open nozzle of caulking tubes made by different manufacturer, and having varying tapering angle and general surface configurations.

Also, the present closure system comprises a plug which is relatively easy to clean and, thus, may be used to reseal a caulking tube more than once.

The present closure system is also relatively simple and economical to produce since the closure system comprises standard off the shelves elements, such as a standard screw in some embodiments and, in other embodiments, a resilient valve element, such as the one integrated in inflatable playing balls.

Other advantages and novel features of the improved closure system will be more apparent from the following drawings and detailed description.

DETAILED DESCRIPTION

Figure 1:
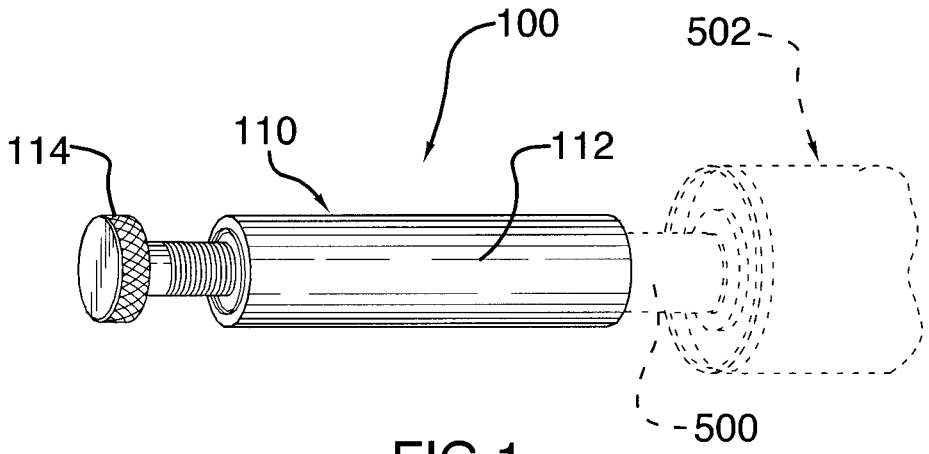
FIG. 1 is a perspective view showing a closure system, in accordance with one embodiment, with the closure system being shown attached to the open end of the nozzle of a caulking tube, and with a threaded plug member partially screwed into a threaded opening at a distal end thereof.
Figure 2:
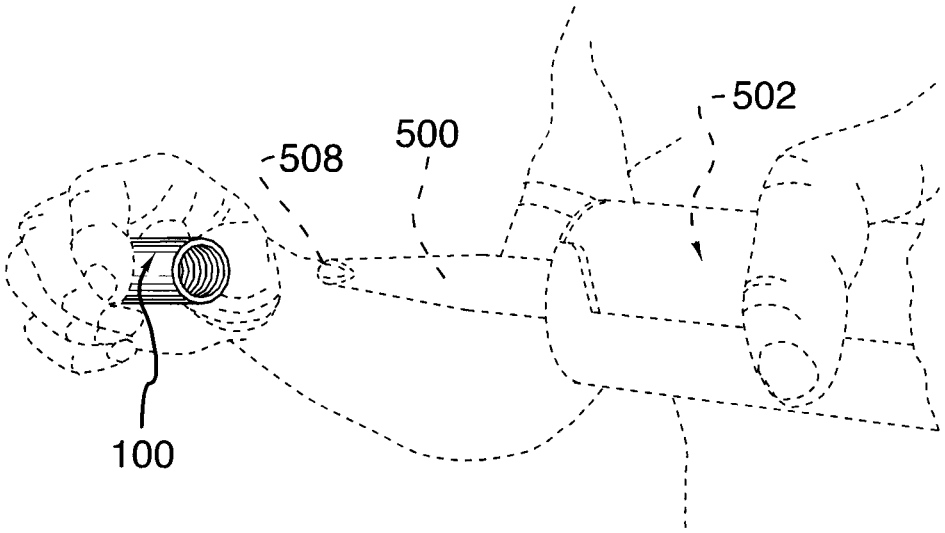
FIG. 2 is another perspective view showing the closure system of FIG. 1, with the closure system shown held in position by a user, near the open end of the nozzle of a caulking tube.
Figure 3:
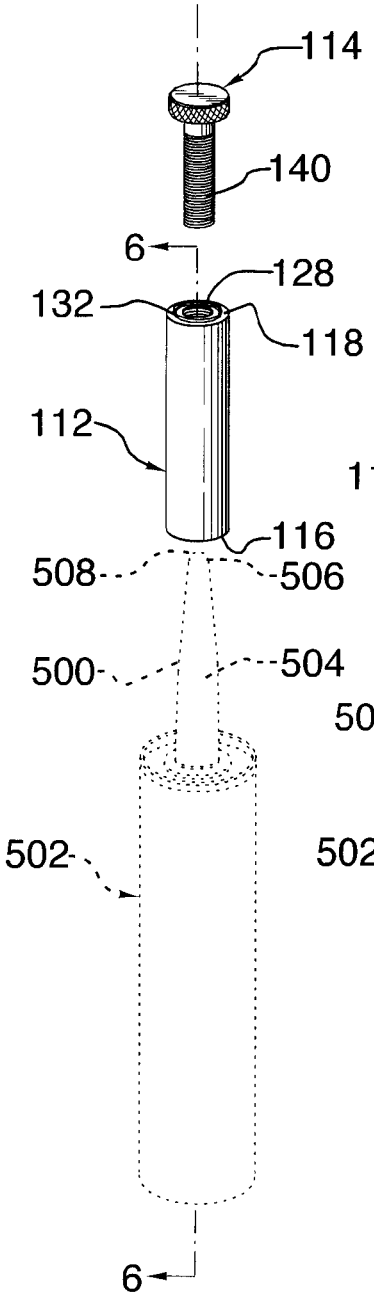
FIGS. 3 to 5 are other perspective views showing the closure system of FIG. 1 being attached to the open end of the nozzle of a caulking tube.
Figure 4:
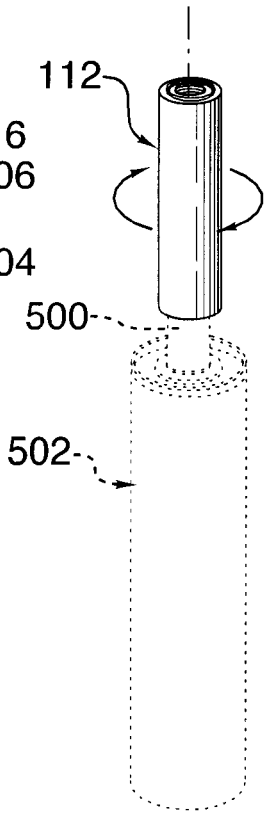
Figure 5:
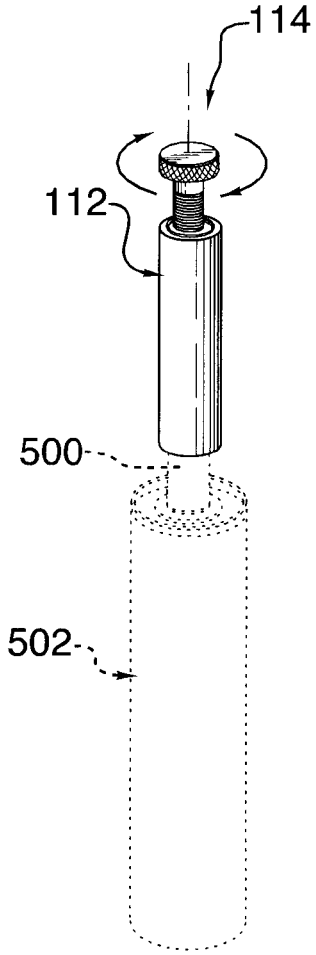

FIGS. 1 to 7 show a closure system 100, in accordance with one embodiment, for resealing a caulking tube nozzle 500 of a conventional caulking tube 502, or a similar device.

A person skilled in the art will appreciate that the caulking tube nozzle 500 of a conventional caulking tube 502 typically comprises a straight cylindrical portion 504 located near the caulking tube 502 and a frusto-conical end portion 506 located away from the caulking tube 502. A dispensing opening 508 is further provided in the frusto-conical end portion 506 to enable caulking to be dispensed. It will be appreciated that the dispensing opening 508 is usually created by a user by cutting the frusto-conical end portion 506 at a certain length. The length of the frusto-conical end portion 506 will therefore vary depending on where the user cuts the caulking tube nozzle 500.

The closure system 100 comprises a hollow adaptor 110 adapted for removably engaging the caulking tube nozzle 500 and a plug 114 for removably engaging the hollow adaptor 110.

In the embodiment illustrated in FIGS. 1 to 7, the hollow adaptor 110 comprises an elongated hollow member 112.

Figure 6:
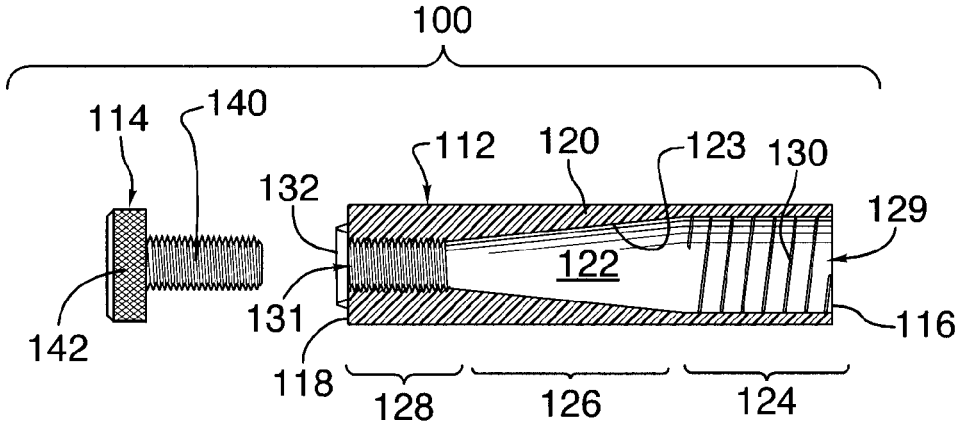
FIG. 6 is a cross-sectional view, taken along section line 6-6, showing the closure system of FIG. 3.
Figure 7:
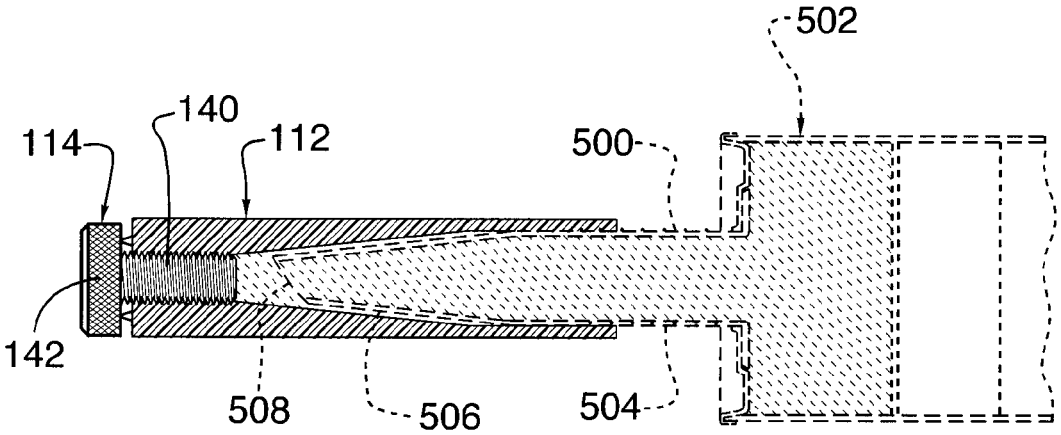
FIG. 7 is a cross-sectional view showing the closure system of FIG. 1, with the closure system attached to, and sealing the open end of the nozzle of a caulking tube.

Referring specifically to FIGS. 6 and 7, the elongated hollow member 112 is generally cylindrical and comprises a first open end 116, a second open end 118 located opposite the first open end 116 and an outer wall 120 extending between the first open end 116 and the second open end 118.

As shown in FIGS. 6 and 7, the outer wall 120 defines a longitudinal passageway 122 which extends between the first open end 116 and the second open end 118. When the elongated hollow member 112 is mounted on the caulking tube nozzle 500, the caulking tube nozzle 500 is received through the first open end 116 and extends into the longitudinal passageway 122. In the embodiment illustrated in FIGS. 1 to 7, the frusto-conical end portion 506 of the caulking tube nozzle 500 fully extends into the longitudinal passageway 122 and the straight cylindrical portion 504 of the caulking tube nozzle 500 extends partially into the longitudinal passageway 122.

The outer wall 120 comprises an inner adaptor surface 123 having a first end portion 124 extending from the first open end 116 towards the second open end 118, a second end portion 128 extending from the second open 118 towards the first open end 116 and an intermediate portion 126 extending between the first and second end portions 124, 128.

The outer wall 120 is sized and shaped to sealingly engage the caulking tube nozzle 500. More specifically, the first end portion 124 has a diameter which is substantially similar to the diameter of the straight cylindrical portion 504 of the caulking tube nozzle 500. This enables the straight cylindrical portion 504 to snuggly fit within the longitudinal passageway 122 and against the first end portion 124 of the inner adaptor surface 123 when the elongated hollow member 112 is mounted on the caulking tube nozzle 500.

Still referring specifically to FIGS. 6 and 7, the first end portion 124 is further provided with engaging means 129 for sealingly and removably engaging the caulking tube nozzle 500.

A person skilled in the art will appreciate that the caulking tube nozzle 500 of a conventional caulking tube 502 is typically made of a relatively soft and resilient plastic material. In the embodiment illustrated in FIGS. 1 to 7, the engaging means 129 comprise a thread-like, helical ridge 130 projecting from the first end portion 124 into the longitudinal passageway 122. The helical ridge 130 is sharp and rigid enough to dig into the straight cylindrical outer face 504 of the caulking tube nozzle 500. The helical ridge 130 may also provide an interference fit with the straight cylindrical outer face 504 of the caulking tube nozzle 500 to further secure the elongated hollow member 112 to the caulking tube nozzle 500, as one skilled in the art will appreciate.

In the embodiment illustrated in FIGS. 1 to 7, the intermediate portion 126 is further tapered at a taper angle similar to a taper angle of the frusto-conical outer face 506 of the caulking tube nozzle 500. In this configuration, when the caulking tube nozzle 500 is fully engaged in the elongated hollow member 112, the frusto-conical outer face 506 of the caulking tube nozzle 500 abuts against the intermediate portion 126 of the inner adaptor surface 123 to create a substantially airtight seal. This helps preventing the hardening of the air-curable material contained in the caulking tube 502.

Alternatively, the intermediate portion 126 need not be tapered at the same taper angle as the frusto-conical outer face 506 of the caulking tube nozzle 500. For instance, the taper angle of the frusto-conical outer face 506 may be sharper than the taper angle of the intermediate portion 126 such that at least a portion of the frusto-conical outer face 506 is spaced from the intermediate portion 126. In this configuration, the elongated hollow member 112 will still sealingly engage the caulking tube nozzle 500, because the first end portion 124 of the inner adaptor surface 123 will still sealingly engage the straight cylindrical outer face 504 of the caulking tube nozzle 500 as described above.

The same closure system 100 can therefore be used with various caulking tube nozzles having different taper angles or configuration, which is of great advantage.

Still referring specifically to FIGS. 6 and 7, the second end portion 128 of the inner adaptor surface 123 is provided with plug engaging means 131 for sealingly engaging the plug 114.

The plug engaging means 131 are configured according to the configuration of the plug 114. For instance, in the embodiment illustrated in FIGS. 1 to 7, the plug 114 comprises an elongated body 140 which is generally cylindrical and externally threaded and a handle portion 142 adapted for enabling a user to rotate the plug 114. Accordingly, the second end portion 128 of the annular wall 120 has a substantially cylindrical configuration and is internally threaded to sealingly and removably engage the elongated body 140 of the plug 114.

The length of the second end portion 128 may be substantially equivalent to the average length of the threaded end of a medium size standard screw to enable a medium size standard screw to be used as the plug 114. In one embodiment, the length of the second end portion 128 is comprised between about 1 inch and about 2 inches.

When the plug 114 engages the elongated hollow member 112, the elongated body 140 of the plug 114 extends into the longitudinal passageway 122 of the elongated hollow member 112, thereby taking up space inside the longitudinal passageway 122. When the elongated hollow member 112 sealingly engages the caulking tube nozzle 500 and the plug 114 sealingly engages the elongated hollow member 112, air inside the longitudinal passageway 122 is therefore prevented from escaping and is slightly compressed, thereby increasing pressure inside the longitudinal passageway 122. This increased pressure further prevents caulking from undesirably being dispensed from the caulking tube 502 when the closure system 100 is mounted on the caulking tube nozzle 500, even if the pressure is inadvertently applied to the caulking tube 502, for instance. In this configuration, the elongated body 140 of the plug 114 therefore acts as a pressure modifying means to modify pressure inside the longitudinal passageway 122.

In one embodiment, the elongated hollow member 112 and/or the plug 114 may also comprise seals such as O-ring seals or the like to further prevent ambient air from entering the longitudinal passageway 122 when the elongated hollow member 112 is mounted on the caulking tube nozzle 500 and the plug 114 sealingly engages the elongated hollow member 112.

In one embodiment, the plug 114 comprises a standard screw or the like, and the handle portion 142 comprises a screw head of the screw. Since a standard screw is relatively inexpensive and readily available from hardware stores or screw manufacturers, this advantageously reduces the cost and time required to manufacture the plug.

The screw may further be selected to provide sufficient grip to the user to be easily manipulated by hand. For instance, the screw may comprise a rounded or hexagonal screw head, or the like.

In the embodiment illustrated in FIGS. 1 to 7, a relatively sharp annular ridge 132 further extends from the second open end 118 of the elongated hollow member 112, away from the elongated hollow member 112, as best shown in FIG. 1. In the illustrated embodiment, the sharp annular ridge 132 is further generally coaxial relative to the longitudinal passageway 122.

It will be appreciated that in some instances, caulking may be present on the exterior of the closure system 100. For example, the user of the closure system 100 may have caulking on his hands after performing a caulking operation and that this caulking may be transferred onto the closure system 100 and particularly on the handle portion 142 of the plug 114 when the user handles the closure system 100.

When the plug 114 is fully engaged in the elongated hollow member 112, the handle portion 142 of the plug 114 abuts the sharp annular ridge 132 and thereby cuts through any caulking material that may have been left to harden on the underside surface of a handle portion 142 of the plug 114.

In an alternative embodiment, the sharp annular ridge 132 may instead be provided on the plug 114 and extend towards the elongated hollow member 112 when the plug 114 engages the elongated hollow member 112. For instance, in the illustrated embodiment, the sharp annular ridge 132 may be provided on the underside of the screw head.

In yet another embodiment, the elongated hollow member 112 may not comprise the sharp annular ridge 132.

In one embodiment, the elongated hollow member 112 and/or the plug 114 are manufactured using a rigid material selected from the group consisting of hard nylon, hard polymer, rust-resistant steel, aluminum, light metal alloy, or any other material deemed suitable by the skilled addressee.

A method for resealing a caulking tube nozzle 500 using the closure system 100 will now be described, with references to FIGS. 3 to 7.

In one step, a user threadingly engages and firmly secures the first open end 116 of the elongated hollow member 112 on the substantially cylindrically shaped base portion 504 of the caulking tube nozzle 500. This may be performed by screwing the elongated hollow member 112 over the caulking tube nozzle 500, or pushing the elongated hollow member 112 towards the caulking tube 502 and simultaneously turning the elongated hollow member 112 in a direction corresponding to the configuration of the helical ridge 130, as one skilled in the art will appreciate. This enables the helical ridge 130 to dig into the substantially cylindrically shaped base portion 504 of the caulking tube nozzle 500.

The caulking tube nozzle 500 is inserted in the elongated hollow member 112 until the frusto-conical outer face 506 abuts against the intermediate portion 126 of the annular wall 120 to create a substantially airtight seal, as described above. In this configuration, caulking in the caulking tube and caulking which may be present in the longitudinal passageway 122 is only exposed to ambient air through the second open end 118 of the elongated hollow member 112.

In one embodiment, this step is performed after the caulking tube 502 has been used in a caulking operation. In this embodiment, a relatively small amount of caulking may slightly protrude from the caulking tube nozzle 500 when the caulking tube nozzle 500 is inserted in the elongated hollow member 112.

In another step, the user engages the elongated body 140 of the plug 114 into the second open end 118 of the elongated hollow member 112 until the underside of the handle-like portion 142 abuts against the annular sharp edge 132. This may be performed by screwing the plug 114 into the elongated hollow member 112, as one skilled in the art will appreciate.

It will be appreciated that when the elongated hollow member 112 tightly secured on the substantially cylindrically shaped base portion 504 of the caulking tube nozzle 500 and further when the plug 114 is engaged in the elongated hollow member 112, an amount of air is trapped inside the longitudinal passageway 122.

As the plug 114 is screwed into the elongated hollow member 112, pressure is increased in the longitudinal passageway 122, as explained above. This prevents caulking from being further dispensed from the caulking tube nozzle 500.

This slight positive air pressure differential thus created in the longitudinal passageway 122 relative to ambient air may further substantially seal any potentially leaking interstitial spaces between the contacting portions of the elongated hollow member 112, the plug 114 and/or the caulking tube nozzle 500.

The embodiment described above provides for a closure system and method of use for caulking tube nozzles that is relatively economical to produce as well as relatively easy to use, compared to nozzle closure systems and methods of use of the prior art. Yet, the present embodiment may offer relatively higher performance in terms of preserving the initial qualities of the caulking material within the tube, and for relatively longer periods of time, compared to comparable prior art systems and methods.

To use the caulking tube 502 again in a normal fashion, the user may simply unscrew the plug 114 from the elongated hollow member 112, and unscrew the elongated hollow member 112 from the nozzle 500. Alternatively, the user may instead directly unscrew the elongated hollow member 112 from the nozzle 500.

Figure 8:
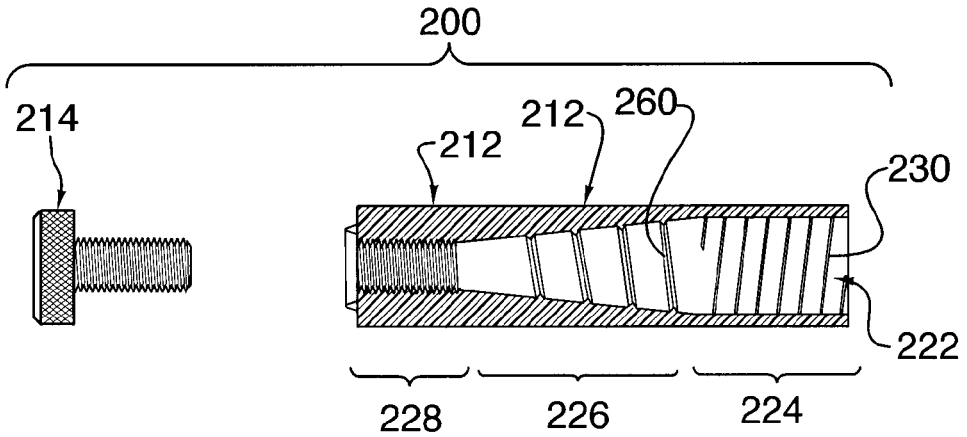
FIG. 8 is a cross-sectional view showing a closure system, according to an alternative embodiment.
Figure 9:
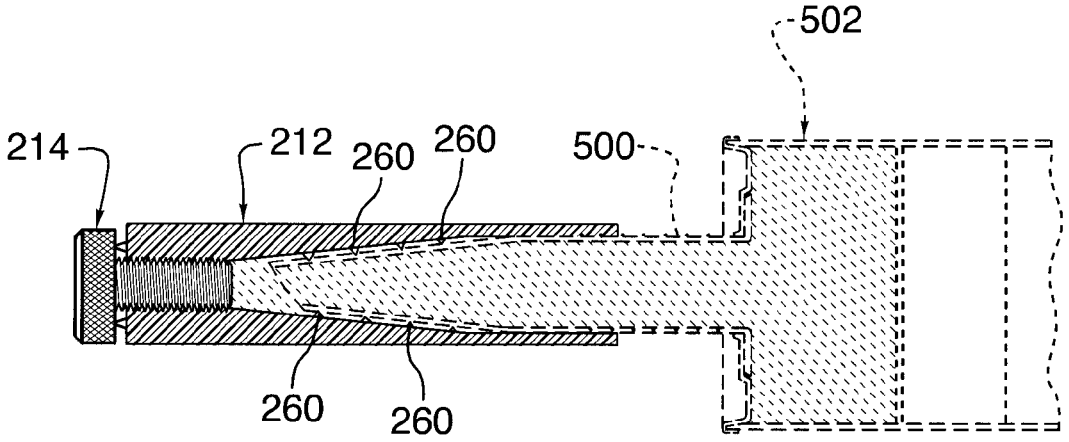
FIG. 9 is a cross-sectional view showing the closure system of FIG. 8, with the closure system attached to, and sealing the open end of the nozzle of a caulking tube.

FIGS. 8 and 9 show a closure system 200, in accordance with an alternative embodiment. Similarly to the embodiment illustrated in FIGS. 1 to 7, the closure system 200 comprises an elongated hollow member 212 and a plug 214. The elongated hollow member 212 comprises a longitudinal passageway 222 comprising first and second end portions 224, 228, which are generally cylindrical, and an intermediate portion 226, which is tapered.

Still similarly to the embodiment illustrated in FIGS. 1 to 7, the first end portion 224 is provided with a helical ridge 230 and the second end portion 228 is internally threaded.

The main difference resides in that the intermediate portion 226 of the longitudinal passageway 222 is provided with a plurality of spaced-apart annular protrusions 260. In the embodiment illustrated in FIGS. 8 and 9, the annular protrusions 260 are integrally formed in the elongated hollow member 212 and are substantially sharp, similarly to the helical ridge 230, to dig into the frusto-conical outer face 506 of the nozzle 500.

Each annular protrusion 260 further defines a central opening which has a certain diameter. The diameters of all of the central openings are selected such that the annular protrusions 260 define a central conical space having a taper angle which is sharper than the taper angle of the intermediate portion 226 of the elongated hollow member 212.

It will be appreciated that this configuration enables the elongated hollow member 212 to be sealingly engaged over nozzles having various configurations. For example, the nozzle of a caulking tube may comprise straight or slightly bulging frusto-conical surfaces and more or less acute tapering angles, depending on their manufacturer. In the present embodiment, the annular protrusions 260 may dig more or less deeply into the nozzle, such that an interference fit is created between the annular protrusions 260 and the nozzle, thereby also creating a substantially airtight seal.

In the embodiment illustrated in FIGS. 8 and 9, the annular protrusions 260 are angled relative to a longitudinal axis of the elongated hollow member 212. Alternatively, the annular protrusions 260 could instead be perpendicular to the longitudinal axis of the elongated hollow member 212.

Figure 10:
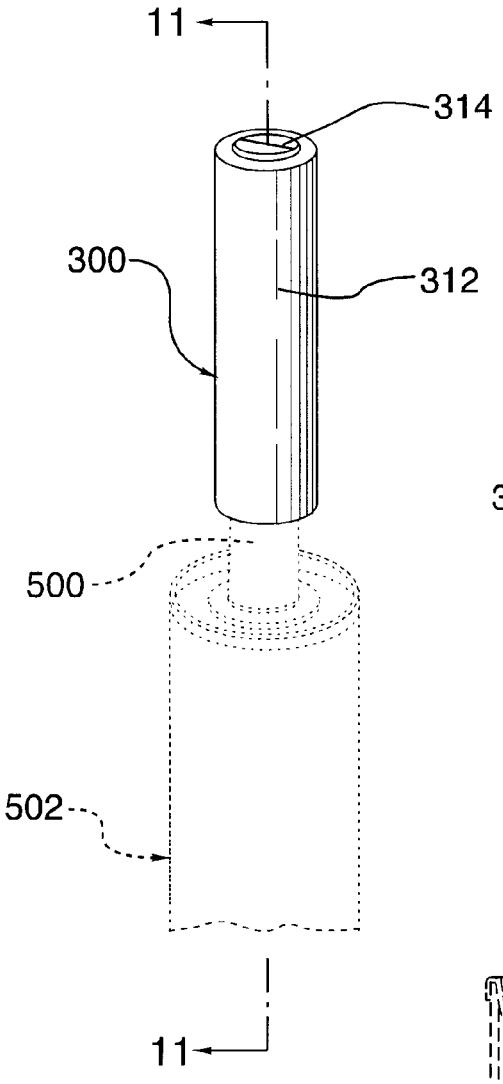
FIG. 10 is a perspective view showing a closure system, according to yet another embodiment, with the closure system attached to, and sealing the open end of the nozzle of a caulking tube.
Figure 11:
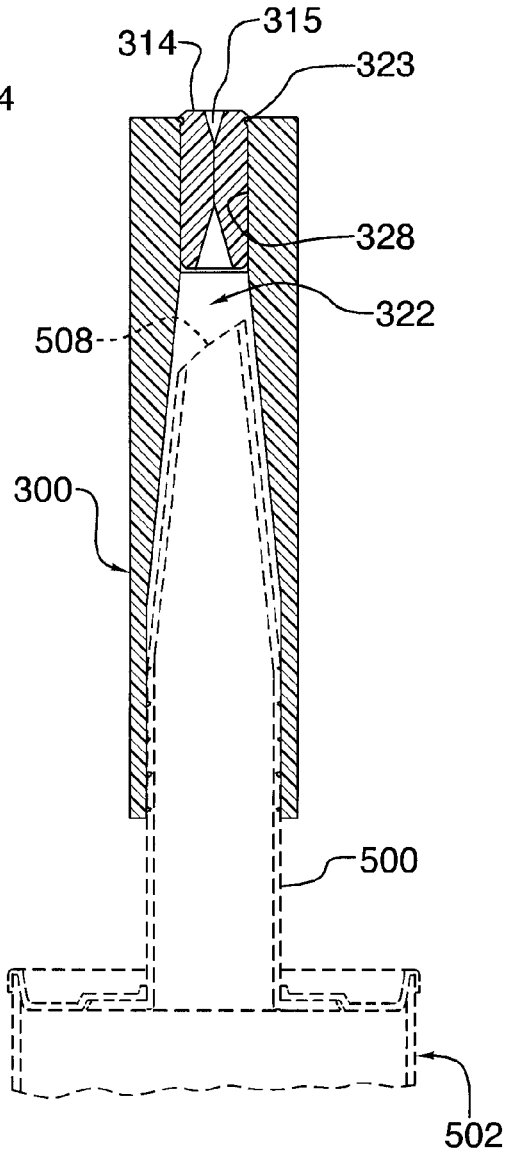
FIG. 11 is a cross-sectional view, taken along section line 11-11, showing the closure system of FIG. 10.

FIGS. 10 and 11 show a closure system 300, in accordance with yet another embodiment. Similarly to the embodiments shown in FIGS. 1 to 9, the closure system 300 comprises an elongated hollow member 312 defining a longitudinal passageway 322 and a plug 314, which is received in a generally cylindrical end portion 328 of the longitudinal passageway 322.

The main difference resides in that the end portion 328 of the longitudinal passageway 322 is not internally threaded, but instead comprises a relatively small annular ridge 323 extending inwardly towards the longitudinal axis of the longitudinal passageway 322 for sealingly engaging the plug 314 to thereby secure the plug 314 to the elongated hollow member 312.

Similarly to the embodiments illustrated in FIGS. 1 to 9, the closure system 300 further comprises pressure modifying means for modifying pressure inside the longitudinal passageway 322.

More specifically, in the embodiment illustrated in FIGS. 10 and 11, the plug 314 comprises a substantially cylindrically shaped valve element made of a resilient material, such as rubber, or the like, which is provided with a central slit 315 extending longitudinally therethrough. This type of resilient valve element is commonly found in inflatable playing balls, for instance, and is used to inflate the latters using a manual or power operated pump. When the plug 314 is inserted into the end portion 328 of the longitudinal passageway 322, a small internal ridge 323 compresses the plug 314 and thereby closes the central slit 315. The plug 314 acts as a closing valve and prevents air from entering the longitudinal passageway 322 once the closure system 300 is sealingly engaged on the caulking tube nozzle 500.

Figure 14:
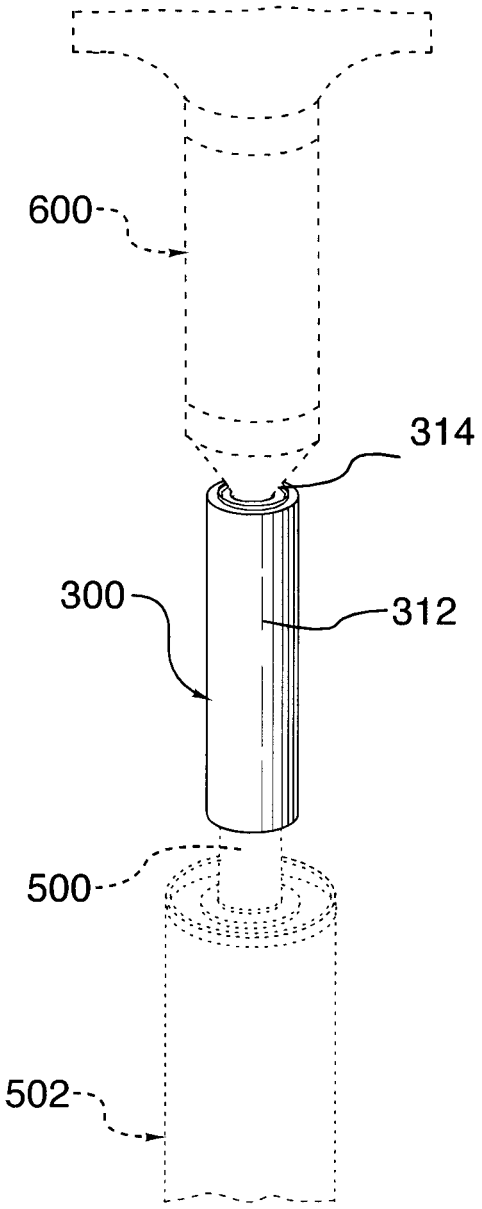
FIG. 14 is a perspective view showing the closure system of FIG. 10, with a vacuum pump in position for pumping air out from the closure system.

In the present embodiment, the plug member 314 may be used in combination with a commercially available vacuum pump such as, for example, the vacuum pump 600 illustrated in FIG. 14. The vacuum pump 600 is similar in shape, size and operation as a manual vacuum pump commonly used to expel air from wine bottles, or from ZipLoc® bags used for freezing vegetables. It will be appreciated that any other pump deemed suitable by the skilled addressee may be used.

A method for resealing a caulking tube nozzle 500 using the closure system 300 will now be described.

Initially, the plug 314 is secured to the elongated hollow member 312, as illustrated in FIGS. 10 and 11.

In one step, the closure system 300 is sealingly engaged on the caulking tube nozzle 500 in a similar fashion as in the previously described embodiments.

In another step, air is expelled from the longitudinal passageway 322. More specifically, the pump 600 is engaged in the central slit 315, as shown in FIG. 14, and is activated to pump out at least partially the air from the longitudinal passageway 322.

Thus, in the present embodiment, a negative air pressure, or vacuum, instead of a positive air pressure, is used to substantially close and seal any potential interstitial leaking spaces between the contacting portions of the hollow member, the valve element and/or the caulking tube nozzle.

This configuration is particularly useful for resealing the caulking tube nozzle of a caulking tube that contains highly curable material in the presence of air, such as caulking tubes typically used in the aerospace industry, and the like. Since this highly curable material is typically highly expensive, this configuration may reduce costs associated with wasted caulking by contributing to preserve this highly curable material, which is of great advantage.

To use the caulking tube 502 again, the user may simply unscrew the closure system 300 from the caulking tube nozzle 500.

Figure 12:
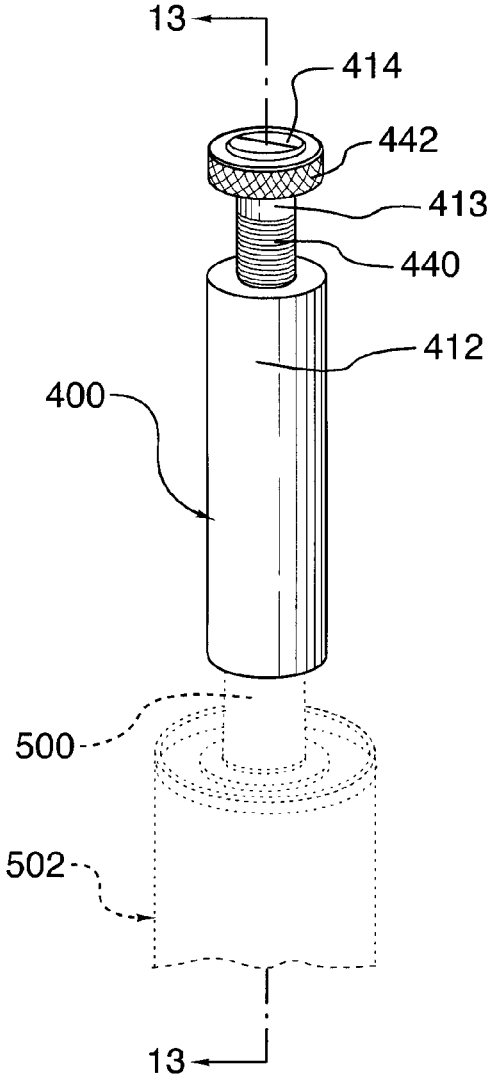
FIG. 12 is a perspective view showing a closure system, according to yet another embodiment, with the closure system attached to, and sealing the open end of the nozzle of a caulking tube.
Figure 13:
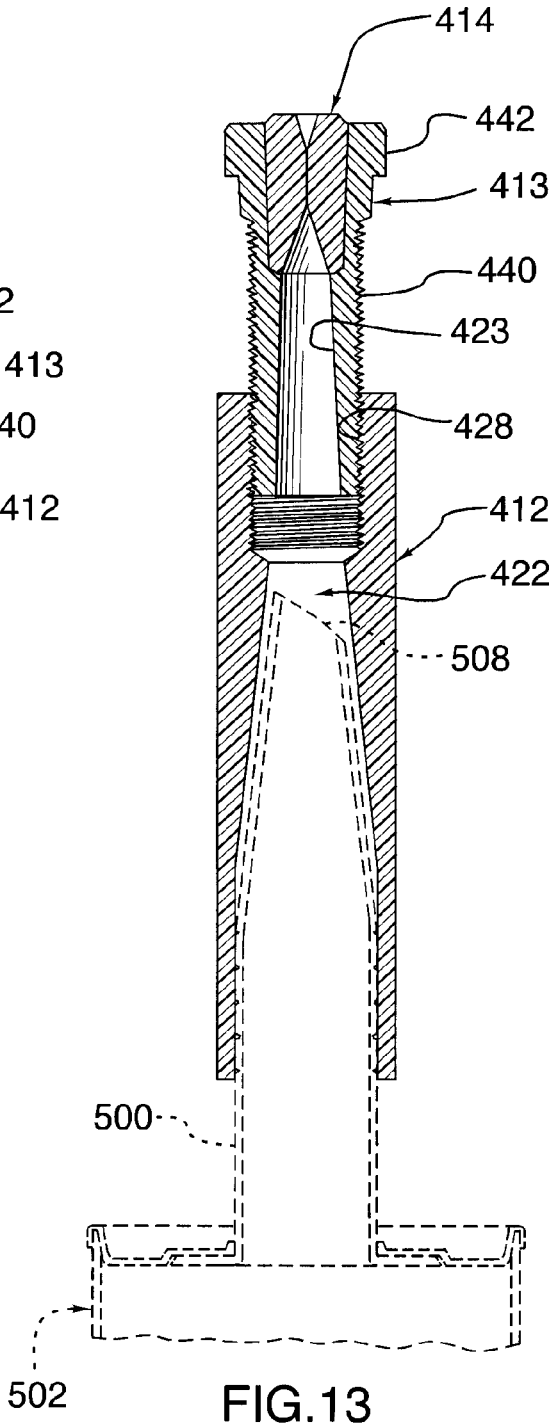
FIG. 13 is a cross-sectional view, taken along section line 13-13, showing the closure system of FIG. 12.

FIGS. 12 and 13 show a closure system 400, in accordance with yet another embodiment. In this particular embodiment, the closure system 400 comprises a first adaptor member or elongated hollow member 412, a second adaptor member or intermediate adaptor 413 and a plug 414.

The elongated hollow member 412 is substantially similar to the elongated hollow member 112 described above. Similarly to the embodiment illustrated in FIGS. 1 to 9, the elongated hollow member 412 comprises a longitudinal passageway 422 having an end portion 428 which is internally threaded.

The intermediate adaptor 413 is substantially similar to the plug 114 described above. More specifically, the intermediate adaptor 413 comprises an end portion 440 which is externally threaded to sealingly engage the end portion 428 of the longitudinal passageway 422 and a handle portion 442. The main difference with the plug 114 is that a tubular passageway 423 extends longitudinally throughout the entire length of intermediate adaptor 413.

The plug member 414 is also substantially similar to the plug member 314 described in the previous embodiment of a closure system 300, and, here again, comprises a resilient valve element.

It will be appreciated that to further seal the various elements threadingly engaged with each other, the internal and/or external threads may be covered by thread seal tape or the like.

Although the above description relates to specific embodiments as presently contemplated by the inventor, it will be understood that the invention in its broad aspect includes mechanical and functional equivalents of the elements described herein.

The invention claimed is:

1. A closure system for resealing a caulking tube nozzle of a caulking tube, the caulking tube nozzle having a straight cylindrical portion located near the caulking tube and a frusto-conical end portion located away from the caulking tube, the closure system comprising:

a hollow adaptor adapted to be removably secured to the caulking tube nozzle, the hollow adaptor comprising a first open end for sealingly receiving the caulking tube nozzle, a second open end and a passageway extending therebetween; and a plug for sealingly engaging the second open end to prevent caulking from exiting the passageway through the second open end, wherein the plug comprises an elongated body extending into the passageway when the plug engages the second open end, thereby increasing pressure in the passageway in order to prevent caulking from being further dispensed from the caulking tube nozzle; and wherein the second end portion of the passageway is internally threaded and the elongated body of the plug is externally threaded to sealingly engage the second end portion.

2. The closure system as claimed in claim 1, wherein the passageway is adapted to receive at least part of the straight cylindrical portion of the caulking tube nozzle.

3. The closure system as claimed in claim 1, wherein the passageway comprises first and second end portions and an intermediate portion extending therebetween.

4. The closure system as claimed in claim 3, wherein the first end portion is cylindrical and has a diameter similar to the diameter of the straight cylindrical portion of the caulking tube nozzle to sealingly engage the straight cylindrical portion of the caulking tube nozzle.

5. The closure system as claimed in claim 3, wherein the intermediate portion is tapered to receive the frusto-conical end portion of the caulking tube nozzle.

6. The closure system as claimed in claim 3, wherein the first end portion comprises a helical ridge for securing the hollow adaptor to the straight cylindrical portion of the caulking tube nozzle.

7. The closure system as claimed in claim 5, wherein the intermediate portion of the longitudinal passageway comprises a plurality of spaced-apart annular protrusions, each annular protrusion defining a central opening having a certain diameter, the diameters of all of the central openings being selected such that the annular protrusions define a central conical space having a taper angle which is sharper than the taper angle of the intermediate portion of the elongated hollow member.

8. The closure system as claimed in claim 7, wherein the plug comprises a conduit extending longitudinally therethrough and a valve mounted in the conduit, the valve being selectively closable for preventing air from entering the passageway, the valve being couplable to pumping means for selectively removing air from the passageway to thereby prevent air from contacting caulking.

9. The closure system as claimed in claim 1, wherein the hollow adaptor comprises a first adaptor member having a first end portion removably securable to the caulking tube nozzle and a second end portion; and a second adaptor member having a first end portion sealingly engageable with the second end portion of the first adaptor member and a second end portion adapted for sealingly receiving the plug.

10. The closure system as claimed in claim 1, wherein the hollow adaptor and the plug are manufactured using a rigid material selected from the group consisting of nylon, polymer, rust-resistant steel, aluminum, and metal alloy.

* * * * *